United States Patent [19]

Nishikubo

[11] 3,939,643

[45] Feb. 24, 1976

[54] CRYSTAL-CONTROLLED ELECTRONIC TIMEPIECE WITH CMOS SWITCHING AND FREQUENCY-DIVIDING CIRCUITS

[75] Inventor: Yasuhiko Nishikubo, Iruma, Japan

[73] Assignee: Citizen Watch Co., Ltd., Tokyo, Japan

[22] Filed: May 30, 1974

[21] Appl. No.: 474,698

[30] Foreign Application Priority Data

| | | |
|---|---|---|
| June 7, 1973 | Japan | 48-64183 |
| Dec. 5, 1973 | Japan | 48-138388 |
| Jan. 7, 1974 | Japan | 49-5175 |

[52] U.S. Cl. ..... 58/23 A; 58/23 R

[51] Int. Cl.[2] ..... G04C 3/00

[58] Field of Search ..... 307/303, 214; 331/46, 47, 331/49, 50, 51, 52, 54; 58/23 R, 23 A, 23 AC, 33, 24 R

[56] References Cited

UNITED STATES PATENTS

| | | | |
|---|---|---|---|
| 3,629,709 | 12/1971 | Engdahl | 58/33 X |
| 3,699,763 | 10/1974 | Zeph | 58/23 R |
| 3,737,673 | 6/1973 | Suzuki | 307/214 X |
| 3,754,391 | 8/1973 | Fujita | 58/23 R |
| 3,765,163 | 10/1973 | Levine et al. | 58/23 A X |

*Primary Examiner*—George H. Miller, Jr.
*Assistant Examiner*—U. Weldon
*Attorney, Agent, or Firm*—Ernest G. Montague; Karl F. Ross; Herbert Dubno

[57] ABSTRACT

An electronic timepiece with a crystal-controlled oscillator includes a multistage frequency divider and a CMOS switching circuit inserted between the oscillator and the first divider stage. The switching circuit comprises two complementary MOSFETs, with insulated gates connected in parallel to an output lead of the oscillator, and at least one further MOSFET in series with the other two, the latter having an insulated gate connected to another output lead of the oscillator for energization in staggered relationship with the former to bring about simultaneous conduction for one brief instant per half-cycle of the generally sinusoidal oscillator voltage. With an oscillator operating at a frequency on the order of megahertz, the divider stages may form part of an upstream and a downstream frequency divider connected in cascade; the upstream divider may consist of nonbinary stages with individual step-down ratios of 3:1 or higher to minimize overall power consumption.

9 Claims, 14 Drawing Figures

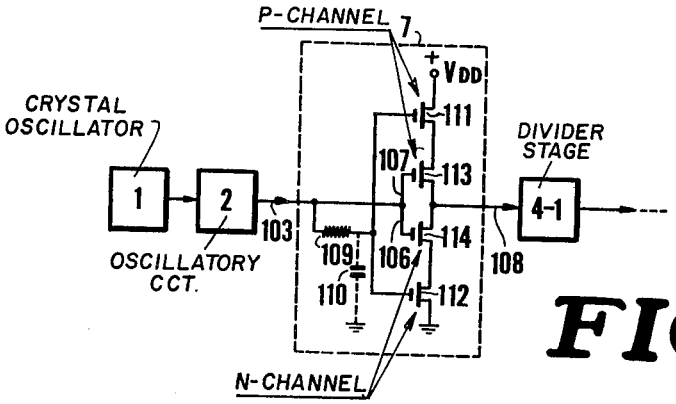
FIG.7.
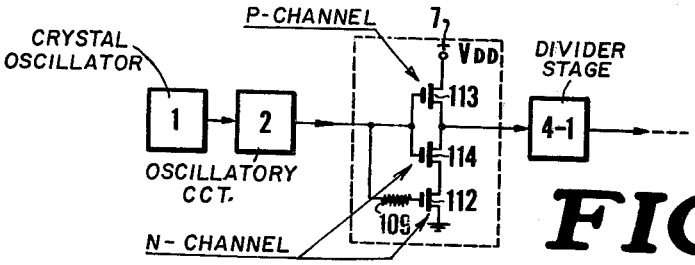
FIG.8.
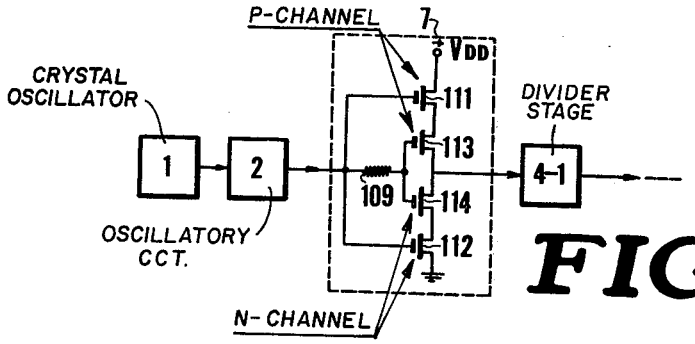
FIG.9.
FIG.10.
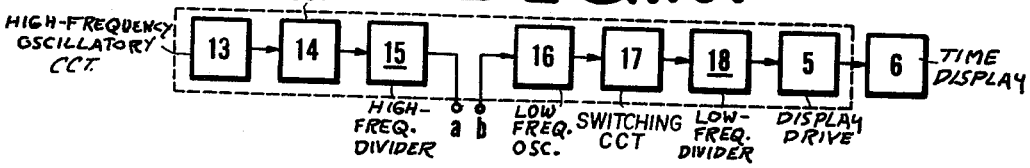

CRYSTAL-CONTROLLED ELECTRONIC TIMEPIECE WITH CMOS SWITCHING AND FREQUENCY-DIVIDING CIRCUITS

This invention relates to an electronic timepiece comprising a crystal oscillator, its output circuit consisting of a switching amplifier of the complementary-MOS-transistor type (hereinafter referred to as CMOS switch), a time-display device and a frequency divider for converting a frequency of the crystal oscillator into a frequency required for operating the time-display device.

According to one aspect of the invention I provide a crystal-oscillator-type electronic timepiece which comprises a buffer or switching circuit for coupling the oscillator output to the frequency divider and which can supply the buffer circuit with a first output signal from the CMOS switch in the oscillatory circuit and with a relatively phase-delayed second output signal for reducing the wasteful consumption of electric power consumed uselessly by the switching circuit.

According to another aspect of my invention a timepiece includes an integrated circuit adapted to be used for both a high-frequency crystal oscillator generating a frequency in a range of, for example, 1 MHz to 10 MHz and a low-frequency crystal oscillator for generating a frequency of, for example, up to 100 KHz and which can serve as a standard circuit component in the mass production of such timepiece.

Pursuant to a further aspect of my invention, the frequency divider is composed of a plurality of stages effecting a frequency division of at least 3:1 in one stage, with consequent reduction of the overall number of stages compared with a conventional binary divider circuit and of the electric power consumed by it.

The above and other features of my invention will now be described in greater detail with reference to the accompanying drawing, wherein.

Figure 5:
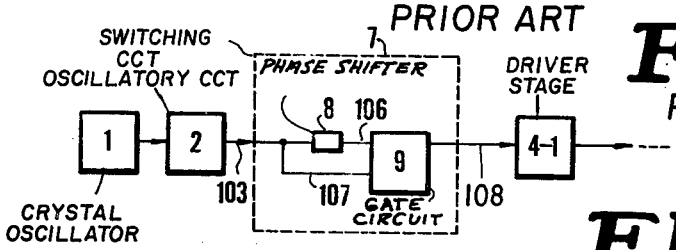
FIG. 5 is a block diagram illustrating the basic structure of a switching circuit according to the invention.
Figure 6:
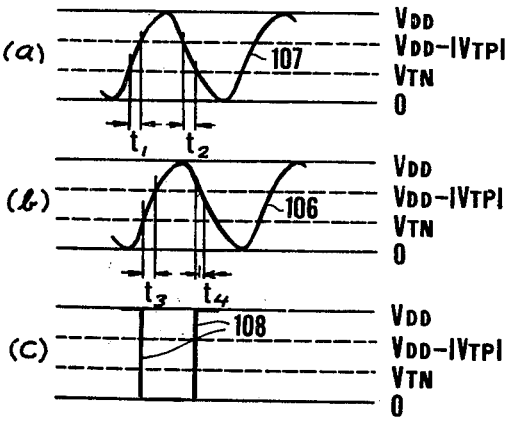
Figure 11:
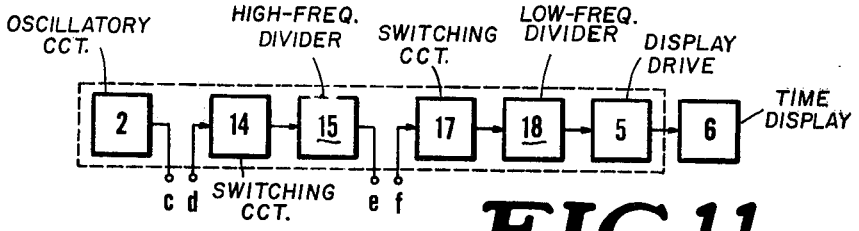
Figure 12:
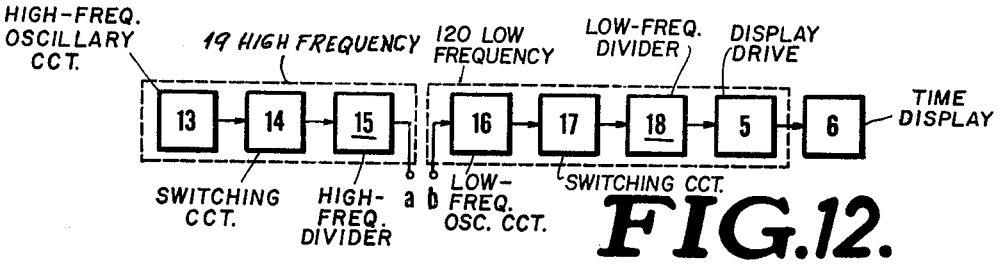
Figure 13:
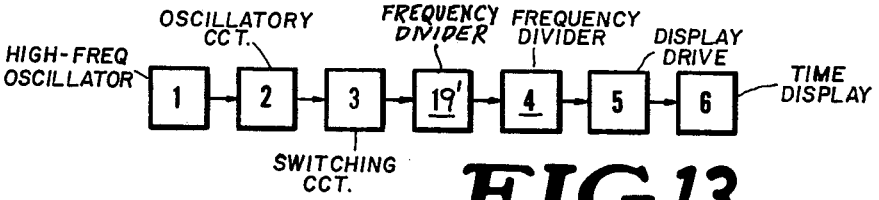
Figure 14:
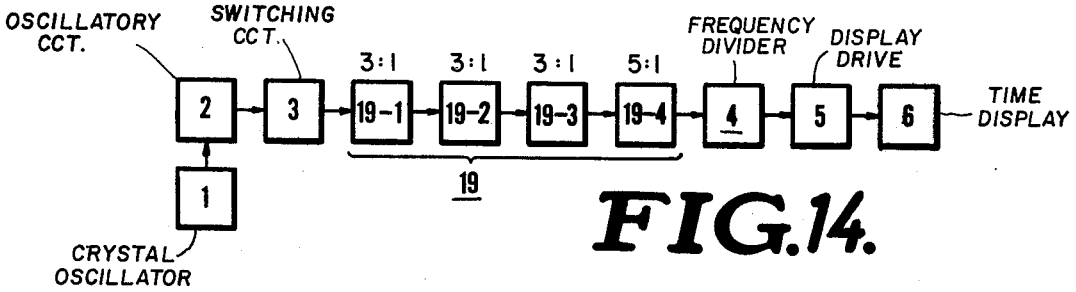

FIG. 6(*a*), 6(*b*), and 6(*c*) are graphs of voltages appearing in to the switching circuit of FIG. 5;

FIG. 7 is a circuit diagram showing details of one form of the switching circuit of FIG. 5;

FIG. 8 is a circuit diagram showing details of another form of switching circuit;

FIG. 9 is a circuit diagram showing details of a further form of switching circuit;

FIG. 10 is an overall block diagram showing one embodiment of an electronic timepiece incorporating an integrated circuit according to the invention;

FIG. 11 is a similar block diagram showing another embodiment of an electronic timepiece incorporating integrated circuit according to the invention;

FIG. 12 is a block diagram showing a further embodiment of an electronic timepiece incorporating an integrated circuit according to the invention;

FIG. 13 is a block diagram showing an electronic timepiece incorporating a non-binary frequency divider with a step-down ratio of at least 3:1 according to the invention; and FIG. 14 is a block diagram showing an electronic timepiece which makes use of a non-binary and a binary frequency divider in cascade.

Figure 1:
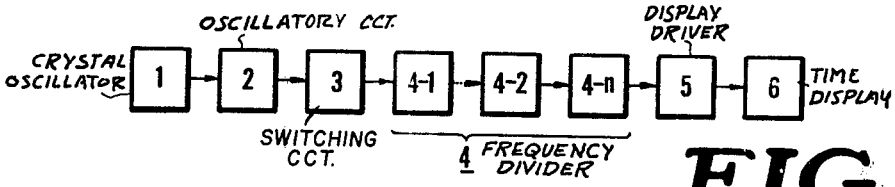
FIG.1. PRIOR ART
FIG. 1 is a block diagram showing the construction of a conventional crystal-oscillator-type electronic timepiece.

In FIG. 1 I have shown a conventional crystal-oscillator type electronic timepiece which makes use of an integrated circuit consisting of a crystal oscillator 1; having an output circuit 2, a buffer or switching circuit, a frequency divider 4 with stages 4-1, 4-2, having a dividing ratio of 2:1, a display driving circuit 5 and a time-display device 6.

Figure 2:
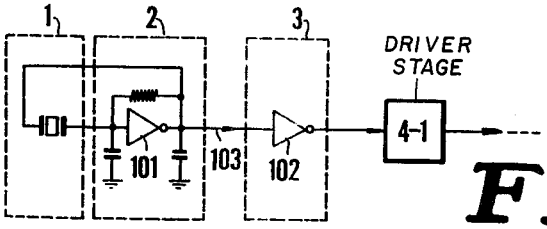
FIG.2. PRIOR ART
FIG. 2 is a circuit diagram showing a conventional buffer or switching circuit of such a timepiece.

FIG. 2 is a circuit diagram showing details of the construction of the crystal its output circuit 1, oscillating 2 and switching circuit 3.

Reference numeral 101 designates a CMOS switch included in the oscillatory circuit 2 feeding, via a lead 103, another CMOS switch 102 forming part of the buffer circuit 3.

Figure 3:
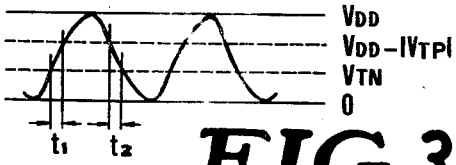
FIG.3. PRIOR ART
FIG. 3 is a graph of the voltage applied to the buffer part shown in FIG. 2.

The electric power consumed by the buffer CMOS switch 102 will now be discussed. The voltage waveform of the oscillation on the output lead 103 from circuit 2 is not rectangular, as would be the case with saturation, but substantially sinusoidal as shown in FIG. 3. Where $V_{DD}$ is a d-c supply voltage, $V_{TN}$ is the threshold voltage of an N-channel MOS transistor and $V_{TP}$ is the threshold voltage of a P-channel MOS transistor.

Figure 4:
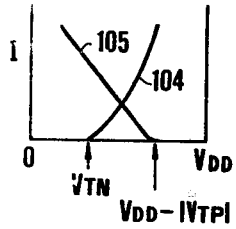
FIG.4. PRIOR ART
FIG. 4 is a graph showing voltage/current characteristics of N-channel and P-channel MOS transistors.

In FIG. 4, a curve 104 shows the voltage/current characteristic of the N-channel transistor and a curve 105 shows the voltage/current characteristic of the P-channel transistor of the inverter.

If a sinusoidal voltage as shown in FIG. 3 is supplied to the input end of the buffer CMOS switch 102, both the P-channel transistor and N-channel transistor thereof become simultaneously conductive for an extended period of time. As a result, a sustained current flows in the transistors and thereby defeats the advantage of minimum power consumption in a CMOS logic circuit. Thus, both the P channel transistor and N-channel transistor of the CMOS switch 102 become simultaneously conductive for periods of time $t_1$ and $t_2$ as the sine wave shown in FIG. 3 passes between the threshold voltage $V_{TN}$ and the difference voltage $V_{DD}$-$/V_{TP}/$ in a range in which the curves 104, 105 of FIG. 4 overlap. As a result, the shorter these periods of time $t_1$ and $t_2$ the lower the power consumption of the CMOS logic circuit.

In order to reduce this power consumption, in accordance with this invention, I provide an improved switching circuit for an electronic timepiece of the aforedescribed type as illustrated generally in FIG. 5 and more particularly in FIG. 7. In FIG. 5, reference numeral 8 designates a phase shifter connected by a lead 106 a gate circuit 9, in parallel with a lead 107. Let it be assumed that the voltage shown in FIG. 3 is supplied to the input lead 103 of the buffer or switching circuit 7 whose phase shifter 8 is composed of a resistor 109 and a CMOS gate capacitance 110 of a pair of field-effect transistors, i.e. a P-channel MAFET 111 and an N-channel MOSFET 112, as shown in FIG. 7.

FIG. 6(b) shows a curve 106 representing a voltage supplied over the correspondingly designated lead of FIGS. 5 and 7 from the phase shifter 8 to the gate circuit 9; curve 107 of FIG. 6(a) shows the waveform of a voltage directly supplied over the correspondingly designated lead from the oscillatory circuit 2 to the gate circuit 9 and curve 108 in FIG. 6(c) shows the waveform of an output voltage delivered by the gate circuit 9 over a correspondingly designated lead. As seen from FIG. 6, the voltage 106 delayed in the phase shifter 8 lags with reference to voltage 107 by a fraction of a quarter-cycle. P-channel transistor 111 and N-channel transistor 112 are thus made simultaneously conductive periods $t_3$ and $t_4$, while the voltage 107 directly supplied to the gate circuit 9 makes a P-channel transistor 113 and an N channel transistor 114 simultaneously conductive for periods $t_1$ and $t_2$. As a result, the switching circuit 7 according to the invention prevents the simultaneous conduction of all P-channel and N-channel insulated-gate transistors 111 to 114 of gating network 9 for more than an instant, corresponding to the narrow voltage spikes 108 in FIG. 6(*c*), owing to the presence of the time shift between periods $t_1$ and $t_3$ on the one hand and periods $t_2$ and $t_4$ on the other hand, even when these transistors are supplied with an oscillator voltage which is not a square wave. In consequence, the output voltage 108 which is delivered in the form of trigger pulses to the frequency-divider stage 4–1 is a purely binary signal.

In FIGS. 8 and 9, I have shown other forms of switching circuit 7 according to the invention. The buffer circuit of FIG. 8 comprises one P-channel transistor 113 and two N-channel transistors 112, 114 omitting the MOSFET 111 of FIG. 7.

The buffer circuit 7 shown in FIG. 9 is substantially the same as that shown in FIG. 7 except that the delayed voltage is applied through the resistor 109 to the two intermediate transistors 113, 114 of the gate circuit 9, while the undelayed voltage is fed to the two outer transistors 111, 112 thereof.

The phase shifter 8 according to the invention is an integral circuit comprising the resistor 109 and gate capacitance 110 of the CMOS switch.

The above-described CMOS logic circuit can be operated with a power consumption of not more than several $\mu$W.

In conventional crystal controlled electronic timepieces oscillation frequencies on the order of up to 100 KHz are generated by low-frequency crystal oscillators of the tuning-fork or double-prong type on the order of megahertz, e.g. in a range of 1 – 10 MHz, produced by a high-frequency crystal oscillator which makes use of an AT cut. The electronic timepiece according to the invention advantageously comprises an integrated circuit which is applicable to both low-frequency and high-frequency crystal oscillators.

In FIG. 10 I have shown an electronic timepiece according to the invention which consists of an integrated circuit, indicated dotted lines, and a time-display device 6, the integrated circuit including a high-frequency oscillatory circuit 13, a buffer or switching circuit 14, a high-frequency divider 15 adapted to step down the operating frequency of circuit 13 to a frequency on the order of 100 KHz equaling that of a low-frequency oscillatory circuit 16, another buffer or switching circuit 17, a low-frequency divider 18, and a display-driving circuit part 5. If a high-frequency crystal oscillator is employed, that oscillator is connected to circuit 13 and all other components are also used, external terminals a, b of the integrated circuit being short-circuited. With utilization of a low-frequency crystal oscillator, that oscillator is connected to circuit 16 and the high-frequency components 13-15 are not used, the terminals a, b being separated.

In the modified system of FIG. 11 in which the oscillatory circuit 2 is usable with either the high-frequency or the low-frequency crystal oscillator mentioned above. This embodiment comprises an integrated circuit shown by a block in dotted lines and including the aforedescribed components 2, 14, 15, 17, 18, and 6. If the oscillating part 2 is coupled to a high-frequency crystal oscillator, external terminals *c* and *d* on the one hand and external terminals *e* and *f* on the other hand are short-circuited. If the circuit 2 is coupled to a low-frequency crystal oscillator, oscillator, external *c* is directly connected to terminal *f* while terminal *d* is grounded and terminal *e* is left unconnected.

In FIG. 12 the integrated circuit of FIG. 10 is divided into two integrated modules; i.e. a high-frequency block 190, including components 13, 14, 15 and terminal a, and a low-frequency block 120, including components 16, 17, 18, 5 and terminal b. The operation is the same as described above.

With a low frequency crystal oscillator operating at not more than about 100 KHz, the frequency must be stepped down by more than ten stages of a binary frequency divider for arriving at the proper frequency for operating the time-display device at a rate of one step per second. If a CMOS logic circuit is used as a binary divider stage power consumption is low and can be disregarded under an ideal static condition. The power P consumed by one stage at the time of switchover is given by the following equation:

$$P = CV_{DD}^2 DD^f \quad (1)$$

where C is a load capacitance, $V_{DD}$ is the supply voltage and *f* is the frequency.

Let the power consumed by the first stage of the frequency divider be $P_o$ the overall power $P_t$ consumed by the entire divider through the $n^{th}$ stage is then given by the following equation:

$$P_t = P_o(1+\tfrac{1}{2}+\tfrac{1}{2}^2 \ldots + \tfrac{1}{2}^{n-1}) \approx 2P_o \quad (2)$$

As seen from the above, the power consumed by the successive stages through the 6th stage, i.e. with $n=6$ is 98% of the power consumed with $n=\infty$. The overall consumed power is 1 to 2 $\mu$W when the frequency at the 1st stage is on the order of 3 KHz.

In a high-precision electronic timepiece comprising a high-frequency crystal oscillator type, operating at a frequency on the order of megahertz, the low power consumption of the conventional CMOS logic circuit could not be realized. Thus, if the frequency of the crystal oscillator is increased 100 times, the power consumed by the frequency divider as a whole becomes 100 times as large. The resulting drain on a battery used as a power supply has made it very difficult to design an electronic timepiece controlled by a high-frequency crystal oscillator.

In FIGS. 13 and 14 I have shown a high-frequency crystal oscillator 1 in an electronic timepiece according to the invention which makes use of a non-binary frequency divider 19 capable of providing a step-down ratio ranging from 3:1 to about 100:1. This higher-order divider is connected in cascade with the binary frequency divider of FIG. 1 and lies on the upstream or high-frequency side of the latter. For example, if crystal oscillator 1 can generate a frequency of 4 MHz and frequency divider consists of one stage having a step-down ratio of 100:1, that one stage can reduce the oscillator frequency of 4 MHz into a frequency of 40 KHz. Thus, it is possible to use binary stages of conventional CMOS logical circuitry in the downstream divider 4.

In this way, the overall consumed power $P_t$ as given by the foregoing equation (2) is reduced to several $\mu$W.

A non-binary divider stage with a step-down ratio of at least 3:1 may comprise an astable multivibrator circuit synchronized with an output signal from a standard crystal oscillator. As is well known such an astable multivibrator may be so adjusted as to be synchronized with a high-frequency input signal a higher-order subharmonic, e.g. at a frequency which corresponds to 1/10 or 1/100 of the frequency of that input signal. A divider stage having a step-down ratio of at least 3:1 could also be designed as a feedback-type dynamic shift register.

In FIG. 14 the upstream frequency divider consists of four stages 19-1, 19-2, 19-3 and 19-4. If the frequency of the crystal oscillator 1 is 4,423,680 Hz and the binary frequency divider 4 is composed of 15 stages, a rate of one pulse per 1 second can be obtained from the last stage of divider 4 if stages 19 - 1 to 19 - 3 of frequency divider 19 have each stepdown ratio of 3:1 and stage 19-4 has a step-down ratio of 5:1.

What is claimed is:

1. An electronic timepiece comprising:

crystal-controlled oscillator means of elevated operating frequency provided with an output circuit;

time-indicating means operable at a reduced frequency;

frequency-divider means inserted between said oscillator means and said time-indicating means for stepping down said elevated frequency to said reduced frequency; and a switching circuit interposed between said output circuit and said frequency-divider means for deriving periodic trigger pulses for said frequency-divider means from an oscillator voltage of said elevated frequency, said switching circuit comprising two complementary MOSFETs and at least one further MOSFET with insulated gates serially connected across a direct-current supply, said output circuit including a first lead terminating at the gates of said complementary MOSFETs, a second lead terminating at the gate of said further MOSFET and delay means in one of said leads for relatively dephasing the oscillator voltage on said leads to an extent making all said MOSFETs simultaneously conductive for a time substantially shorter than a period of passage of said oscillator voltage between respective conduction thresholds of said complementary MOSFETs.

2. An electronic timepiece as defined in claim 1 wherein said switching circuit includes a fourth MOSFET complementing said further MOSFET and having an insulated gate connected to said second lead.

3. An electronic timepiece as defined in claim 1 wherein said delay means includes a resistor in series with the gate capacitance of at least one of said MOSFETs.

4. An electronic timepiece as defined in claim 1 wherein the relative phase shift introduced by said delay means substantially equals the period of passage of said oscillator voltage between said conduction thresholds.

5. An electronic timepiece as defined in claim 1 wherein said elevated frequency is on the order of megahertz, said frequency-divider means comprising a binary downstream divider and an upstream divider with at least one higher-order stage in cascade with said downstream divider, said higher-order stage having a step-down ratio of at least 3:1.

6. An electronic timepiece as defined in claim 5 wherein said upstream divider consists of a plurality of higher-order stages.

7. An electronic timepiece as defined in claim 6 wherein several of said higher-order stages have a step-down ratio of 3:1.

8. An electronic timepiece as defined in claim 6 wherein said higher-order stages include a stage with a step-down ratio of 5:1.

9. An electronic timepiece as defined in claim 8 wherein said upstream divider consists of three stages with a step-down ratio of 3:1 in addition to said stage with a step-down ratio of 5:1.

* * * * *